US010571831B1

(12) United States Patent
Takahashi et al.

(10) Patent No.: US 10,571,831 B1
(45) Date of Patent: Feb. 25, 2020

(54) PRINTER AND PRINTING METHOD

(71) Applicant: TOSHIBA TEC KABUSHIKI KAISHA, Shinagawa-ku, Tokyo (JP)

(72) Inventors: Masaki Takahashi, Yokohama Kanagawa (JP); Isao Yahata, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/170,491

(22) Filed: Oct. 25, 2018

(51) Int. Cl.
*G03G 21/16* (2006.01)
*G03G 15/16* (2006.01)

(52) U.S. Cl.
CPC ..... *G03G 15/161* (2013.01)

(58) Field of Classification Search
CPC ..... G03G 15/131; G03G 15/189; G03G 15/2039; G03G 15/6585; G03G 2215/81; G03G 2215/00805; G03G 2215/136; G03G 2215/193
USPC ..... 399/101, 296–299, 302, 308, 341
See application file for complete search history.

(56) References Cited

U.S. PATENT DOCUMENTS 7,567,775 B2 * 7/2009 Fukuhara ..... G03G 15/1695 399/302
7,941,078 B2 * 5/2011 Bae ..... G03G 15/0121 399/231
7,991,328 B2 * 8/2011 Masui ..... G03G 15/0121 399/223
8,626,040 B2 * 1/2014 Kasai ..... G03G 15/6585 399/298
8,913,942 B2 * 12/2014 Yamaguchi ..... G03G 15/2057 399/341
2013/0164004 A1 6/2013 Ai

FOREIGN PATENT DOCUMENTS

JP 2002-318482 A 10/2002
JP 2005-265917 A 9/2005
JP 2012-032541 A 2/2012

* cited by examiner

*Primary Examiner* — Hoan H Tran
(74) *Attorney, Agent, or Firm* — Foley & Lardner LLP

(57) ABSTRACT

A printer includes a sheet feeder; an intermediate transfer body; a first image forming device; a second image forming device arranged downstream of the first image forming device; a secondary transfer roller arranged downstream of the second image forming device; and a processor. The processor moves the secondary transfer roller away from the intermediate transfer body, primarily transfers a second toner image onto the intermediate transfer body, rotates the intermediate transfer body until the second toner image reaches the first image forming device, primarily transfers the first toner image onto the intermediate transfer body by superimposing the first toner image on the second toner image, causes the secondary transfer roller to contact the intermediate transfer body, and secondarily transfers the first toner image and the second toner image onto the sheet using the secondary transfer roller. The printer further includes a fixing device.

14 Claims, 6 Drawing Sheets

PRINTER AND PRINTING METHOD

FIELD

Embodiments described herein relate generally to a printer and a printing method.

BACKGROUND

A printer which prints images using a decolorable toner that can be decolored and a non-decolorable toner that cannot be decolored is provided. Also, there is a printer which uses dedicated transparent toner and non-decolorable toner, and decorates an image formed with the non-decolorable toner with the transparent toner to make the image glossy.

There is a printer which effectively fixes the toner image formed with the non-decolorable toner on a sheet having unevenness by fixing the dedicated transparent toner under the toner image formed with the non-decolorable toner.

DETAILED DESCRIPTION

Figure 1:
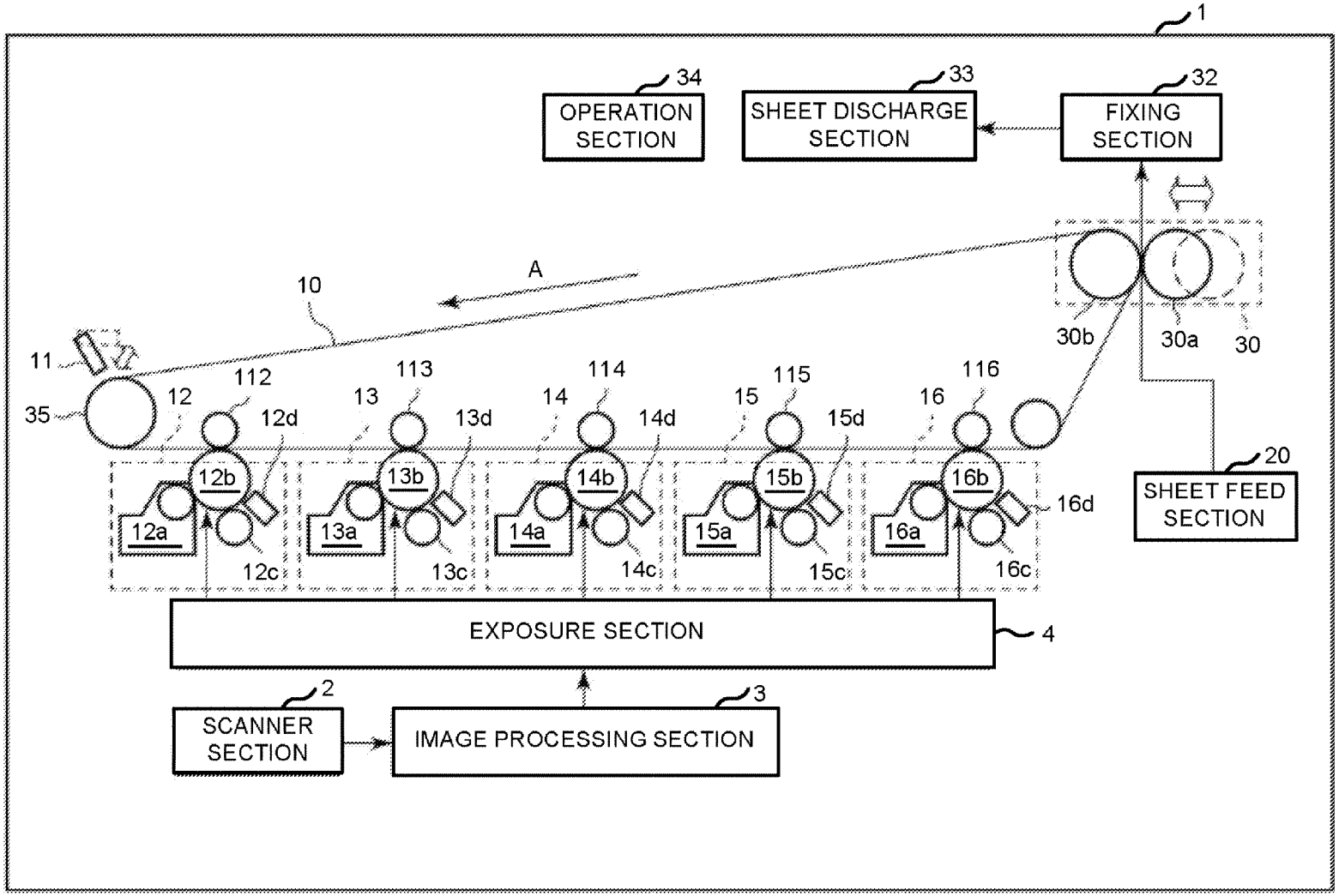
FIG. 1 is a diagram illustrating an example of a configuration of a printer according to a first embodiment.

A printer that can select a hierarchical relationship between a toner image formed with non-decolorable toner and a toner image formed with decolorable toner to be fixed on the sheet is desirable.

In accordance with some embodiments, a printer comprises a sheet feeder configured to feed a sheet; an intermediate transfer body formed into a belt shape; a first image forming device configured to primarily transfer a first toner image formed with a first toner onto the intermediate transfer body; a second image forming device, arranged at a downstream side of the first image forming device in a direction in which the intermediate transfer body rotates, configured to primarily transfer a second toner image formed with a second toner onto the intermediate transfer body; a secondary transfer roller, arranged at the downstream side of the second image forming device in the direction described above, configured to secondarily transfer the first toner image and the second toner image from the intermediate transfer body onto the sheet; a processor configured to primarily transfer the first toner image onto the intermediate transfer body using the first image forming device, to primarily transfer the second toner image onto the intermediate transfer body using the second image forming device by superimposing the second toner image on the first toner image, to secondarily transfer the first toner image and the second toner image onto the sheet using the secondary transfer roller; or configured to cause the secondary transfer roller to move away from the intermediate transfer body, to primarily transfer the second toner image onto the intermediate transfer body using the second image forming device, to rotate the intermediate transfer body until the second toner image reaches a position of the first image forming device, to primarily transfer the first toner image onto the intermediate transfer body using the first image forming device by superimposing the first toner image on the second toner image, to enable secondary transfer roller to contact with the intermediate transfer body, and to secondarily transfer the first toner image and the second toner image onto the sheet using the secondary transfer roller; and a fixing device (fixer) configured to fix the first toner image and the second toner image on the sheet.

Hereinafter, some embodiments are described with reference to the accompanying drawings.

The printer according to some embodiments prints an image on the sheet set in a sheet feed section, such as a cassette or a manual feed section. For example, the printer is a MFP (Multifunction Peripheral) or the like. The printer forms an image on the sheet using a non-decolorable toner (first toner, second toner) and a decolorable toner (second toner, first toner). The printer simultaneously forms a toner image formed with the non-decolorable toner and a toner image formed with the decolorable toner on the sheet. The printer heats the sheet at a decoloring temperature of the decolorable toner or higher. In other words, the printer fixes the toner image formed with the non-decolorable toner and the toner image formed with the decolorable toner on the sheet, and simultaneously decolors the toner image formed with the decolorable toner.

First Embodiment

First, the first embodiment is described.

FIG. 1 is a diagram illustrating an example of a configuration of a printer 1. The printer 1 is an image forming apparatus. Specifically, the toner includes the decolorable toner and the non-decolorable toner. The decolorable toner has a property of being decolored by external stimuli. The "decoloring" refers to making an image formed with a color (including not only a chromatic color but also an achromatic color such as white or black) different from a color of a ground of the sheet visually invisible. For example, the external stimulus includes temperature, light of a specific wavelength and pressure. In at least one embodiment, the decolorable toner is decolored at a prescribed decoloring temperature or higher. The decolorable toner develops color at a prescribed restoring temperature or lower after decoloring. Any toner may be used as the decolorable toner as long as it has the characteristics described above. For example, a coloring agent of the decolorable toner may be a leuco dye. The decolorable toner may be an appropriate combination of a developer, a decolorizing agent, a discoloration temperature adjusting agent and the like.

As shown in FIG. 1, the printer 1 includes a scanner section (scanner) 2, an image processing section (image processor) 3, an exposure section (an exposer) 4, an intermediate transfer body 10, a cleaning blade 11, image forming sections (image formers) 12 to 16, a sheet feed section (sheet feeder) 20, a secondary transfer section 30, a fixing section (fixer) 32, a sheet discharge section (a sheet discharger) 33, an operation section 34, a roller 35 and primary transfer rollers 112 to 116.

Transfer processes in the printer 1 include a first transfer process and a second transfer process. In the first transfer process, the primary transfer rollers 112 to 116 transfer a toner image formed with a toner on a photoconductive drum of each image forming section onto the intermediate transfer body 10. In the second transfer process, the secondary transfer section 30 transfers the toner images formed with the toners and laminated on the intermediate transfer body 10 onto the sheet.

The scanner section 2 reads an image formed on a document which is a scanning object. For example, the scanner section 2 reads the image on the sheet to generate image data of three primary colors, i.e., red (R), green (G) and blue (B). The scanner section 2 outputs the generated image data to the image processing section 3. In the printer 1, when copying is performed using a copying function, the document is read by the scanner section. On the other hand, the printer 1 transmits print image information to the image processing section 3 when the print image information transmitted from a personal computer or the like is printed. In this case, the function of the scanner section 2 stops.

The image processing section 3 converts the image data to color signals of respective colors. For example, the image processing section 3 converts the image data to image data (color signals) of four colors, i.e., yellow (Y), magenta (M), cyan (C) and black (K). The image processing section 3 controls the exposure section 4 based on the color signal of each color. The image processing section 3 may convert image data from another device into color signals of respective colors.

The exposure section 4 irradiates (exposes) the photoconductive drums of the image forming sections 12 to 16 with light. The exposure section 4 is provided with an exposure light source such as a laser, an LED (Light Emitting Diode) and the like.

The intermediate transfer body 10 is formed as a belt, so as to have an endless belt shape. The intermediate transfer body 10 rotates in an arrow A direction shown in FIG. 1. The intermediate transfer body 10 is formed by being hung from the roller 35 to the secondary transfer section 30. Specifically, the intermediate transfer body 10 is held by a roller 35 and a secondary transfer opposed roller 30*b* described later. On the surface of the intermediate transfer body 10, a toner image is formed by the image forming sections 12 to 16.

Here, the arrow A direction side is referred to as a downstream side, and a reverse direction side thereof is referred to as an upstream side.

The image forming section 12 (first image forming device) forms a decolorable toner image (a first toner image) on the intermediate transfer body 10 using the decolorable toner.

The image forming sections 13 to 16 (second image forming devices) form non-decolorable toner images (second toner images) on the intermediate transfer body 10 using the non-decolorable toner. The image forming sections 13 to 16 are arranged at the downstream side of the image forming section 12. The image forming sections 13 to 16 are arranged in order towards the downstream side along the intermediate transfer body 10.

The primary transfer rollers 112 to 116 are used when the toner images formed by the image forming sections 12 to 16 are transferred onto the intermediate transfer body 10. The primary transfer rollers 112 to 116 are formed at positions facing the image forming sections 12 to 16 across the intermediate transfer body 10, respectively. The primary transfer rollers 112 to 116 contact with the intermediate transfer body 10 and enable the intermediate transfer body 10 to contact with each of the image forming sections 12 to 16.

The sheet feed section 20 (sheet feeder) feeds the sheet. For example, the sheet feed section 20 is a cassette built in the printer 1. The sheet feed section 20 may be a manual sheet feed tray or the like projecting out of the printer 1.

The secondary transfer section 30 transfers the toner images (the decolorable toner image and the non-decolorable toner images) formed on the intermediate transfer body 10 onto the sheet. The secondary transfer section 30 is formed at the downstream side of the image forming sections 12 to 16. The secondary transfer section 30 includes a secondary transfer roller 30*a* and the secondary transfer opposed roller 30*b*. The secondary transfer roller 30*a* and the secondary transfer opposed roller 30*b* are arranged so as to sandwich the intermediate transfer body 10 therebetween.

The secondary transfer section 30 has a structure in which the sheet is inserted between the intermediate transfer body 10 and the secondary transfer roller 30*a*. The secondary transfer roller 30*a* enables the sheet to contact with the toner image on the intermediate transfer body 10 to secondarily transfer the toner image onto the sheet.

The secondary transfer roller 30*a* can move away from the intermediate transfer body 10. When the secondary transfer roller 30*a* moves away from the intermediate transfer body 10, the toner image on the intermediate transfer body 10 can pass through the secondary transfer section 30 without being damaged.

For example, the secondary transfer roller 30*a* is moved away from or contacts with the intermediate transfer body 10 by a driving section such as a motor.

The cleaning blade 11 removes toner adhering to the intermediate transfer body 10. Specifically, the cleaning blade 11 removes the toner that is not secondarily transferred onto the sheet by the secondary transfer section 30 and left on the intermediate transfer body 10. The cleaning blade 11 is installed at the downstream side of the secondary transfer section 30. The cleaning blade 11 is, for example, a plate-like member. The cleaning blade 11 is made of rubber such as urethane resin, for example.

The cleaning blade 11 can move away from the intermediate transfer body 10. For example, at the time of removing the toner from the intermediate transfer body 10, the cleaning blade 11 contacts with the intermediate transfer body 10. At the time of not removing the toner from the intermediate transfer body 10, the cleaning blade 11 moves away from the intermediate transfer body 10. For example, the cleaning blade 11 moves away from or contacts with the intermediate transfer body 10 by a driving section such as a motor.

The fixing section 32 (fixing device) fixes the toner image transferred onto the sheet on the sheet by heating and pressing the sheet. The fixing section 32 heats the toner image formed with the decolorable toner to fix the toner image while decoloring the toner image. For example, the fixing section 32 includes a heater, a fixing belt heated by the heater, a press roller for pressing the sheet towards the fixing belt, and the like.

The sheet discharge section 33 discharges the sheet on which the toner image is fixed by the fixing section 32. For example, the sheet discharge section 33 has a structure that exposes the sheet to the outside.

The operation section (as may be, for example, an operation panel or operation display) 34 receives an input of various operations from an operator. The operation section 34 transmits a signal indicating the received operation to a processor 41 described later. For example, the operation section 34 includes a keyboard, a numeric keypad, and a touch panel.

The roller 35 drives the intermediate transfer body 10. The roller 35 rotates the intermediate transfer body 10 in the A direction by rotating on its own axis. The roller 35 is connected to a motor or the like. The roller 35 rotates on its own axis by a driving force from the motor.

Next, the image forming sections 12 to 16 are described. The image forming section 12 accommodates the decolorable toner. The color of the decolorable toner accommodated in the image forming section 12 is not limited to a specific color.

The image forming sections 13 to 16 respectively accommodate toners of respective colors corresponding to four colors for color printing. Four colors for color printing are yellow (Y), magenta (M), cyan (C) and black (K). The toners of four colors for color printing are non-decolorable toners.

First, the image forming section 12 is described.

The image forming section 12 is provided with a developing device 12*a*, a photoconductive drum 12*b*, a charging device 12*c* and a cleaning blade 12*d*.

The developing device 12*a* accommodates the toner. The developing device 12*a* enables the toner to adhere to the photoconductive drum 12*b*.

The photoconductive drum 12*b* is a concrete example of an image carrier (image carrying module). The photoconductive drum 12*b* includes a photoconductor (photoconductive area) on the outer peripheral surface thereof. For example, the photoconductor may be an organic photoconductor (OPC).

The charging device 12*c* uniformly charges the surface of the photoconductive drum 12*b*.

The cleaning blade 12*d* removes the toner adhering to the photoconductive drum 12*b*. The cleaning blade 12*d* is, for example, a plate-like member. The cleaning blade 12*d* is made of rubber such as urethane resin, for example.

The image forming sections 12 to 16 have the same configuration except that the accommodated toner is different. Thus, the description of the image forming sections 13 to 16 is omitted.

Figure 2:
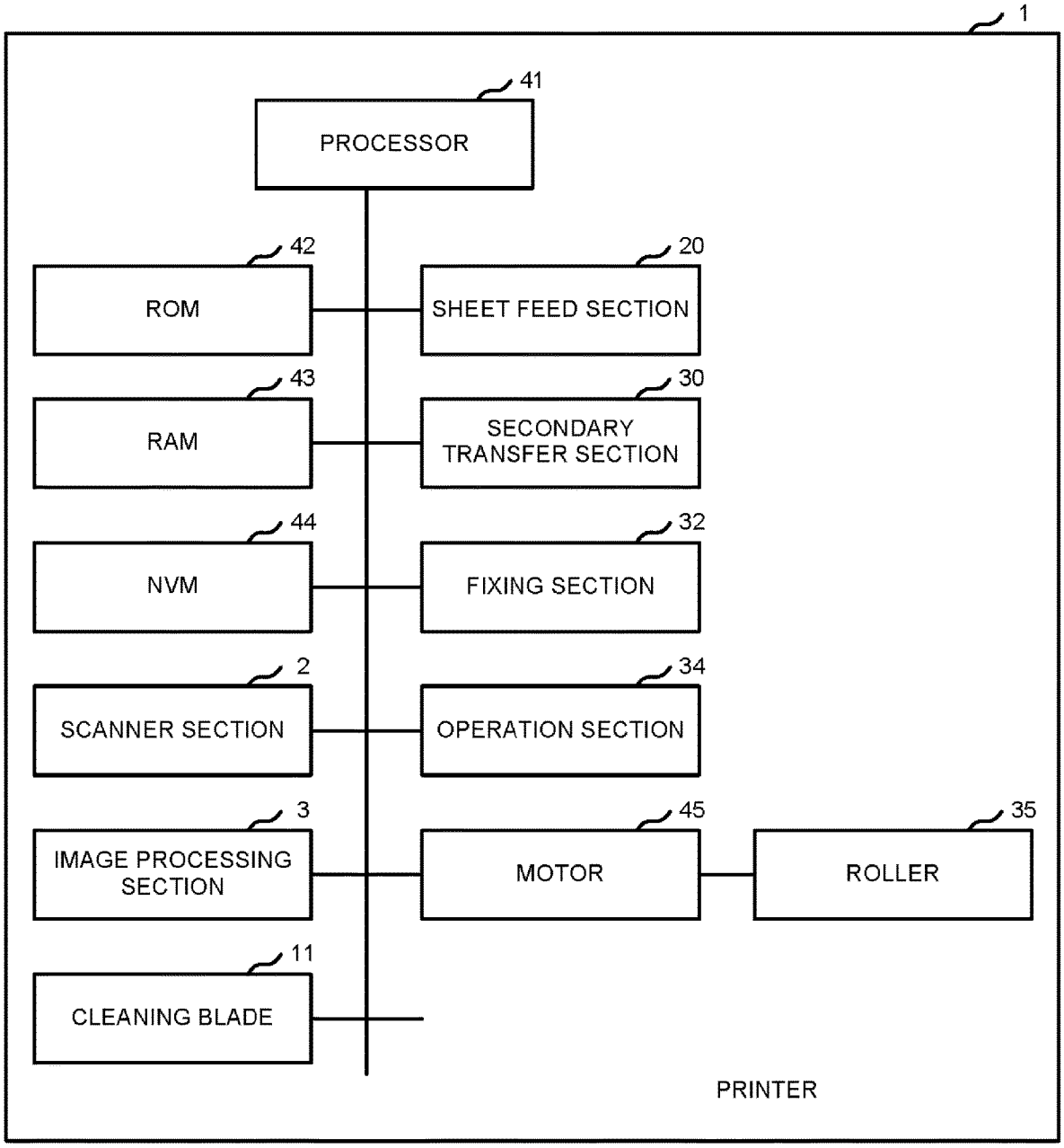
FIG. 2 is a block diagram illustrating an example of a configuration of a printer according to the first embodiment.

Next, an example of a configuration of a control system of the printer 1 is described. FIG. 2 is a diagram illustrating an example of a configuration of a control system of the printer 1. As shown in FIG. 2, the printer 1 includes the scanner section 2, the image processing section 3, the cleaning blade 11, the sheet feed section 20, the secondary transfer section 30, the fixing section 32, the operation section 34, the roller 35, a motor 45, the processor 41, a ROM (Read Only Memory) 42, a RAM (Random Access Memory) 43, an NVM (Non-Volatile Memory) 44, and the like. The processor 41, the scanner section 2, the image processing section 3, the cleaning blade 11, the sheet feed section 20, the secondary transfer section 30, the fixing section 32, the operation section 34, the motor 45, the ROM 42, the RAM 43 and the NVM 44 are connected to each other via a data bus or the like. The processor 41, the scanner section 2, the image processing section 3, the cleaning blade 11, the sheet feed section 20, the secondary transfer section 30, the fixing section 32, the operation section 34, the motor 45, the ROM 42, the RAM 43 and the NVM 44 may be connected to each other via a predetermined interface. The motor 45 and the roller 35 are physically connected.

The scanner section 2, the image processing section 3, the cleaning blade 11, the sheet feed section 20, the secondary transfer section 30, the fixing section 32, the operation section 34 and the roller 35 are as described above.

The processor 41 has a function of controlling the whole operation of the printer 1. The processor 41 may have an internal cache, various interfaces and the like. The processor 41 realizes various processing by executing programs stored in the internal memory, the ROM 42 or the NVM 44 in advance.

A part of the various functions realized by executing the programs by the processor 41 may be realized by a hardware circuit. In this case, the processor 41 controls functions performed by the hardware circuit.

The ROM 42 is a nonvolatile memory in which a control program, control data and the like are stored in advance. The control program and the control data stored in the ROM 42 are incorporated in advance according to the specification of the printer 1. The ROM 42 stores, for example, programs for controlling a circuit board of the printer 1.

The RAM 43 is a volatile memory. The RAM 43 temporarily stores data being processed by the processor 41. The RAM 43 stores various application programs based on a command from the processor 41. Furthermore, the RAM 43 may store data necessary for executing the application program, an execution result of the application program, and the like.

The NVM 44 is a nonvolatile memory capable of writing and rewriting data. The NVM 44 is, for example, an HDD (Hard Disk Drive), an SSD (Solid State Drive), a flash memory or the like. The NVM 44 stores control programs, applications, various data and the like according to an operation purpose of the printer 1.

The motor 45 drives the roller 35 under the control of the processor 41. In other words, the motor 45 rotates the intermediate transfer body 10.

The printer 1 may have a configuration as required in addition to the components as shown in FIG. 1 and FIG. 2, or a specific component may be excluded from the printer 1.

Figure 3:
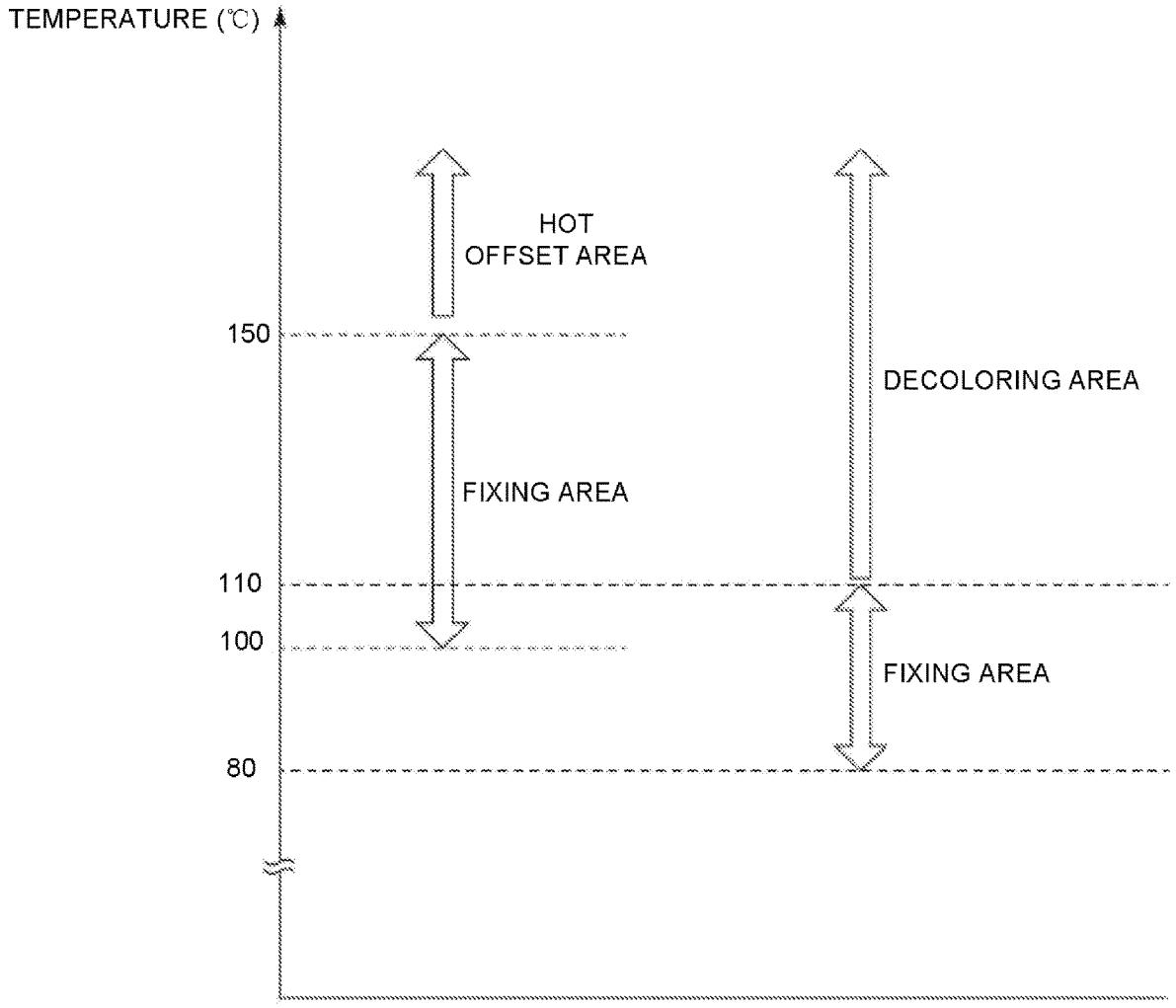
FIG. 3 is a graph illustrating a fixing temperature of a non-decolorable toner and a decolorable toner according to the first embodiment.

Next, fixing temperatures and decoloring temperatures of the non-decolorable toner and the decolorable toner are described. FIG. 3 is a graph illustrating the fixing temperatures, the decoloring temperatures, etc. of the non-decolorable toner and the decolorable toner.

In FIG. 3, the graph on the left shows the fixing temperature and a hot offset temperature of the non-decolorable toner. As shown in FIG. 3, the non-decolorable toner is fixed on the sheet when heated at a temperature in a range of 100 to 150 degrees centigrade.

The hot offset temperature is a temperature at which the hot offset occurs in which the non-decolorable toner is overheated and an adhesive strength thereof is weakened. As shown in FIG. 3, the hot offset occurs in the non-decolorable toner when heated above 150 degrees centigrade.

In FIG. 3, the graph on the right shows the fixing temperature and the decoloring temperature of the decolorable toner. As shown in FIG. 3, the decolorable toner is fixed on the sheet when heated at a temperature in a range of 80 to 110 degrees centigrade.

The decolorable toner is decolored when heated to 110 degrees centigrade or higher.

Therefore, in order to fix the non-decolorable toner and the decolorable toner and decolor the decolorable toner, the processor 41 heats the non-decolorable toner and the decolorable toner at a temperature in a range of 110 to 150 degrees centigrade.

Next, the functions realized by the printer 1 are described. The functions realized by the printer 1 are realized by executing the programs stored in the ROM 42 or the NVM 44 by the processor 41.

First, the processor 41 has a function of forming a toner image on the intermediate transfer body 10 using the image forming sections 12 to 16.

For example, the user sets a document in the scanner section 2. The processor 41 drives the scanner section 2 to acquire image data of the set document. The processor 41 may acquire the image data from an external device.

Based on the image data, the processor 41 forms a toner image on the intermediate transfer body 10. The processor 41 uses the decolorable toner or the non-decolorable toner to form the toner image. The processor 41 controls the exposure section 4 with the image processing section 3. The processor 41 forms a toner image on the photoconductive drums 12*b* to 16*b* by controlling the exposure section 4. The processor 41 primarily transfers the toner image on the photoconductive drums 12*b* to 16*b* onto the intermediate transfer body 10.

Here, the operation of transferring the toner image onto the intermediate transfer body 10 by the image forming section 12 is schematically described.

The photoconductive drum 12*b* is charged to a predetermined potential by the charging device 12*c*. Next, light is emitted from the exposure section 4 to the photoconductive drum 12*b* under the control of the processor 41. In this way, electric potential at an area irradiated with the light on the photoconductive drum 12*b* changes. Through the change of the electric potential, an electrostatic latent image is formed on the surface of the photoconductive drum 12*b*. The electrostatic latent image on the surface of the photoconductive drum 12*b* is developed using the toner on the developing device 12*a*. In other words, the toner image is formed on the surface of the photoconductive drum 12*b*.

The toner image formed on the surface of the photoconductive drum 12*b* is transferred onto the intermediate transfer body 10 by the primary transfer roller 112 facing the photoconductive drum 12*b*. After the transfer, a part of the toner contained in the toner image may be left on the photoconductive drum 12*b* without being transferred onto the intermediate transfer body 10.

The cleaning blade 12*d* removes the toner left on the photoconductive drum 12*b* from the photoconductive drum 12*b*.

The image forming sections 13 to 16 similarly transfer the toner image onto the intermediate transfer body 10.

At the time of forming a decolorable toner image on the intermediate transfer body 10, the processor 41 uses the image forming section 12 to form the toner image.

At the time of forming a non-decolorable toner image on the intermediate transfer body 10, the processor 41 uses the image forming sections 13 to 16 to form the toner images. In this case, the processor 41 transfers the toner images formed by the image forming sections 13 to 16 onto the intermediate transfer body 10 in such a manner that the toner images overlap with each other.

The processor 41 also has a function of primarily transferring the decolorable toner image and the non-decolorable toner image onto the intermediate transfer body 10 with the decolorable toner image below the non-decolorable toner image.

In this case, when the toner image is transferred from the intermediate transfer body 10 onto the sheet, the non-decolorable toner image and the decolorable toner image are formed on the sheet in such a manner that the non-decolorable toner image is below the decolorable toner image. As a result, when the decolorable toner image and the non-decolorable toner image on the sheet are heated by the fixing section 32 at a temperature at which the decolorable toner is decolored while the decolorable toner and the non-decolorable toner are fixed, the decolorable toner becomes transparent and can make the image on the sheet glossy.

For example, the processor 41 forms the decolorable toner image and the non-decolorable toner image on the intermediate transfer body 10 with the decolorable toner image below the non-decolorable toner image when receiving operations, such as an operation to make the sheet glossy.

First, the processor 41 primarily transfers the decolorable toner image onto the intermediate transfer body 10 using the image forming section 12. At the time of the primary transfer of the non-decolorable toner images onto the intermediate transfer body 10, the processor 41 primarily transfers the non-decolorable toner images onto the intermediate transfer body 10 using the image forming sections 13 to 16 by superimposing the non-decolorable toner images on the decolorable toner image. For example, the processor 41 controls the roller 35 and the like to primarily transfer the non-decolorable toner images on top of the decolorable toner image.

Specifically, the processor 41 superimposes the non-decolorable toner images on the decolorable toner image on the intermediate transfer body 10 in the order of yellow (Y), magenta (M), cyan (C) and black (K).

The processor 41 also has a function of forming the decolorable toner image and the non-decolorable toner image on the intermediate transfer body 10 with the non-decolorable toner image below the decolorable toner image.

In this case, when the toner images are transferred from the intermediate transfer body 10 onto the sheet, the decolorable toner image is formed below the non-decolorable toner image on the sheet. As a result, when the decolorable toner image and the non-decolorable toner image are heated by the fixing section 32 at a temperature at which the decolorable toner is decolored and the decolorable toner and the non-decolorable toner are fixed, the decolorable toner becomes transparent. Therefore, a transparent toner image is formed below the non-decolorable toner image on the sheet. For example, when the sheet having unevenness such as an embossed sheet is used, the unevenness is filled with the non-decolorable toner image. Therefore, the printer 1 can effectively fix the non-decolorable toner image on the sheet.

For example, the processor 41 forms the decolorable toner image and the non-decolorable toner image on the intermediate transfer body 10 with the non-decolorable toner image below the decolorable toner image when receiving an operation to fill the unevenness of the sheet, to compensate for the uneven profile of the sheet.

First, the processor 41 moves the secondary transfer roller 30*a* away from the intermediate transfer body 10. In an initial state, if the secondary transfer roller 30*a* is separated from the intermediate transfer body 10, the processor 41 may not perform the above operation.

When the secondary transfer roller 30*a* is moved away from the intermediate transfer body 10, the processor 41 moves the cleaning blade 11 away from the intermediate transfer body 10. In the initial state, if the cleaning blade 11 is separated from the intermediate transfer body 10, the processor 41 may not perform the above operation.

If the cleaning blade 11 is moved away from the intermediate transfer body 10, the processor 41 controls the roller 35 and the like to rotate the intermediate transfer body 10. The processor 41 primarily transfers the non-decolorable toner images onto the intermediate transfer body 10 using the image forming sections 13 to 16 in a superimposed manner. For example, the processor 41 controls the rollers 35 and the like to primarily transfer the non-decolorable toner images respectively formed by the image forming sections 13 to 16 onto the intermediate transfer body 10 in a superimposed manner. Specifically, the processor 41 superimposes the non-decolorable toner images on the intermediate transfer body 10 in the order of yellow (Y), magenta (M), cyan (C) and black (K).

When the non-decolorable toner image is primarily transferred onto the intermediate transfer body 10, the processor 41 rotates the intermediate transfer body 10 until the non-decolorable toner images formed in a superimposed manner reach the position of the image forming section 12. Specifically, the processor 41 rotates the intermediate transfer body 10 until a position where the primary transfer is performed by superimposing the decolorable toner image on the non-decolorable toner image is reached. At this time, since the secondary transfer roller 30*a* and the cleaning blade 11 are moved away from the intermediate transfer body 10, the non-decolorable toner image is conveyed without being removed by the secondary transfer roller 30*a* and the cleaning blade 11.

When the intermediate transfer body 10 is rotated until the non-decolorable toner image reaches the position of the image forming section 12, the processor 41 uses the image forming section 12 to primarily transfer the decolorable toner image onto the intermediate transfer body 10 by superimposing the decolorable toner image on the non-decolorable toner image. For example, the processor 41 controls the roller 35 and the like to transfer the decolorable toner image on top of the non-decolorable toner image.

The processor 41 may move the cleaning blade 11 and the secondary transfer roller 30*a* away from the intermediate transfer body 10 after primarily transferring the non-decolorable toner image. The processor 41 may move each of the cleaning blade 11 and the secondary transfer roller 30*a* away from the intermediate transfer body 10 before the non-decolorable toner image passes through the secondary transfer roller 30*a* and the cleaning blade 11.

The processor 41 also has a function of secondarily transferring the non-decolorable toner image and the decolorable toner image primarily transferred onto the intermediate transfer body 10 onto the sheet.

First, the processor 41 enables the secondary transfer roller 30*a* to contact with the intermediate transfer body 10. In the initial state, if the secondary transfer roller 30*a* is in contact with the intermediate transfer body 10, the processor 41 may not perform the above operation.

When enabling the secondary transfer roller 30*a* to contact with the intermediate transfer body 10, the processor 41 enables the cleaning blade 11 to contact with the intermediate transfer body 10. In the initial state, when the cleaning blade 11 is in contact with the intermediate transfer body 10, the processor 41 may not perform the above operation.

When enabling the cleaning blade 11 to contact with the intermediate transfer body 10, the processor 41 picks up the sheets from the sheet feed section 20 one by one and conveys them to the secondary transfer section 30. The processor 41 controls the roller 35 and the like to enable the non-decolorable toner image and the decolorable toner image to contact with the sheet in the secondary transfer section 30. Specifically, the processor 41 secondarily transfers the non-decolorable toner image and the decolorable toner image onto the sheet.

For example, a voltage (bias) is applied to the secondary transfer opposed roller 30*b*. Therefore, an electric field is generated between the secondary transfer opposed roller 30*b* and the secondary transfer roller 30*a*. With this electric field, the secondary transfer section 30 secondarily transfers the non-decolorable toner image and the decolorable toner image formed on the intermediate transfer body 10 onto the sheet.

The processor 41 also has a function of fixing the non-decolorable toner image and the decolorable toner image secondarily transferred onto the sheet and decoloring the decolorable toner using the fixing section 32.

The processor 41 conveys the sheet onto which the non-decolorable toner image and the decolorable toner image are secondarily transferred to the fixing section 32. At the time of conveying the sheet to the fixing section 32, the processor 41 heats the non-decolorable toner image and the decolorable toner image at a predetermined temperature using the fixing section 32. The processor 41 heats the non-decolorable toner image and the decolorable toner image at a temperature at which the non-decolorable toner image is fixed, the hot temperature offset does not occur and the decolorable toner image is decolored. In the example shown in FIG. 3, the processor 41 heats the non-decolorable toner image and the decolorable toner image at a temperature in a range of 110 to 150 degrees centigrade.

If the non-decolorable toner image and the decolorable toner image are heated at a predetermined temperature, the processor 41 discharges the sheet to the sheet discharge section 33.

Figure 4:
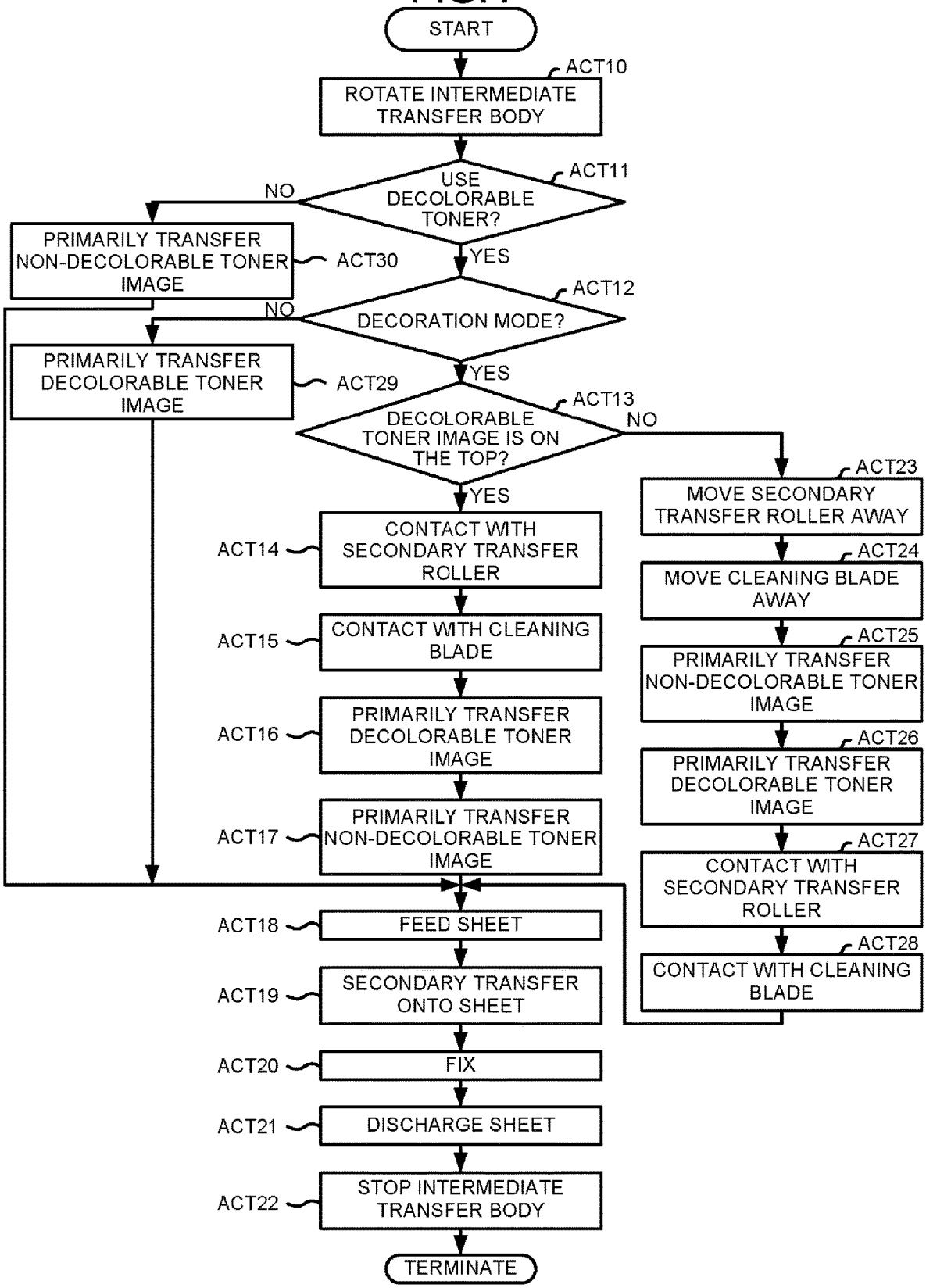
FIG. 4 is a flowchart depicting an example of an operation by a printer according to the first embodiment.

Next, an example of an operation by the printer 1 is described. FIG. 4 is a flowchart depicting an example of the operation by the printer 1.

Here, it is assumed that the processor 41 acquires the image data.

First, after start of the operation, the processor 41 rotates the intermediate transfer body 10 with the motor 45 (ACT 10). After the intermediate transfer body 10 is driven to rotate, the processor 41 determines whether to use the decolorable toner for printing (ACT 11). For example, the processor 41 receives an input of an operation indicating whether to use the decolorable toner through the operation section 34 or the like.

If it is determined that the decolorable toner is used (Yes in ACT 11), the processor 41 determines whether a decoration mode is set (ACT 12). The decoration mode is a mode in which the non-decolorable toner image and the decolorable toner image are printed in a superimposed manner. For example, the processor 41 receives an input of an operation indicating whether to set the decoration mode through the operation section 34 or the like.

If it is determined that the decoration mode is set (Yes in ACT 12), the processor 41 determines whether to print the decolorable toner image on top of the non-decolorable toner image (ACT 13). For example, the processor 41 receives an input of an operation indicating whether to print the decolorable toner image on top of the non-decolorable toner image through the operation section 34 or the like.

If it is determined that the decolorable toner image is printed on top of the non-decolorable toner image (Yes in ACT 13), the processor 41 enables the secondary transfer roller 30*a* of the secondary transfer section 30 to contact with the intermediate transfer body 10 (ACT 14). If the secondary transfer roller 30*a* contacts with the intermediate transfer body 10, the processor 41 enables the cleaning blade 11 to contact with the intermediate transfer body 10 (ACT 15).

If the cleaning blade 11 contacts with the intermediate transfer body 10, the processor 41 primarily transfers the decolorable toner image onto the intermediate transfer body 10 using the image forming section 12 based on the image data (ACT 16).

If the decolorable toner image is primarily transferred, the processor 41 superimposes the non-decolorable toner images on the decolorable toner image on the intermediate transfer body 10 using the image forming sections 13 to 16 based on the image data (ACT 17).

If the non-decolorable toner images are primarily transferred, the processor 41 feeds a sheet from the sheet feed section 20 (ACT 18). When the sheet is fed, the processor 41 secondarily transfers the decolorable toner image and the non-decolorable toner image primarily transferred onto the intermediate transfer body 10 onto the sheet using the secondary transfer section 30 (ACT 19).

If the decolorable toner image and the non-decolorable toner image are secondarily transferred, the processor 41 heats the sheet using the fixing section 32 to fix the decolorable toner image and the non-decolorable toner image on the sheet (ACT 20). If the decoration mode is set, the processor 41 decolors the decolorable toner image. Specifically, the processor 41 heats the sheet at a temperature at which the decolorable toner image and the non-decolorable toner image are fixed and the decolorable toner is decolored.

If the decolorable toner image and the non-decolorable toner image are fixed on the sheet, the processor 41 discharges the sheet to the sheet discharge section 33 (ACT 21). If the sheet is discharged, the processor 41 stops the intermediate transfer body (ACT 22) and terminates the operation.

If it is determined to print the decolorable toner image on the underside of the non-decolorable toner image (No in ACT 13), the processor 41 moves the secondary transfer roller 30*a* of the secondary transfer section 30 away from the intermediate transfer body 10 (ACT 23). If the secondary transfer roller 30*a* is moved away from the intermediate transfer body 10, the processor 41 moves the cleaning blade 11 away from the intermediate transfer body 10 (ACT 24).

If the cleaning blade 11 is moved away from the intermediate transfer body 10, the processor 41 primarily transfers the non-decolorable toner images on the intermediate transfer body 10 in a superimposed manner using the image forming sections 13 to 16 based on the image data (ACT 25).

If the non-decolorable toner images are primarily transferred and the non-decolorable toner images on the intermediate transfer body 10 reach the image forming section 12, the processor 41 primarily transfers the decolorable toner image onto the intermediate transfer body 10 by superimposing the decolorable toner image on the non-decolorable toner images using the image forming section 12 based on the image data (ACT 26).

If the decolorable toner image is primarily transferred, the processor 41 enables the secondary transfer roller 30*a* of the secondary transfer section 30 to contact with the intermediate transfer body 10 (ACT 27). If the secondary transfer roller 30*a* contacts with the intermediate transfer body 10, the processor enables the cleaning blade 11 to contact with the intermediate transfer body 10 (ACT 28).

If the cleaning blade 11 contacts with the intermediate transfer body 10, the processor 41 proceeds to the processing in ACT 18.

If it is determined that the decoration mode is not set (No in ACT 12), the processor 41 primarily transfers the decolorable toner image onto the intermediate transfer body 10 using the image forming section 12 based on the image data (ACT 29). If the decolorable toner image is primarily transferred, the processor 41 proceeds to the processing in ACT 18.

If it is determined that the decolorable toner is not used (No in ACT 11), the processor 41 primarily transfers the non-decolorable toner images onto the intermediate transfer body 10 in a superimposed manner using the image forming sections 13 to 16 based on the image data (ACT 30). If the non-decolorable toner images are primarily transferred, the processor 41 proceeds to the processing in ACT 18.

The processor 41 may primarily transfer one of the non-decolorable toner images onto the intermediate transfer body 10. The printer 1 may not include the image forming sections 13 to 15.

The processor 41 may form decolorable toner images on the top and underside of the non-decolorable toner images on the intermediate transfer body 10. For example, the processor 41 moves the secondary transfer roller 30*a* and the cleaning blade 11 away from the intermediate transfer body 10. If the secondary transfer roller 30*a* and the cleaning blade 11 are moved away, the processor 41 primarily transfers the decolorable toner image and the non-decolorable toner images onto the transfer body 10 in a superimposed manner using the image forming sections 12 to 16. If the decolorable toner image and the non-decolorable toner images are primarily transferred onto the intermediate transfer body 10 in a superimposed manner, the processor 41 rotates the intermediate transfer body 10 until the decolorable toner image and each non-decolorable toner image reach the image forming section 12. After the intermediate transfer body 10 is rotated, the processor 41 primarily transfers the decolorable toner image by superimposing the decolorable toner image on the decolorable toner image and the non-decolorable toner images using the image forming section 12. Furthermore, if the decolorable toner image is superimposed and primarily transferred, the processor 41 secondarily transfers the decolorable toner images and the non-decolorable toner images from the intermediate transfer body 10 onto the sheet and fixes them.

The processor 41 may primarily transfer the decolorable toner image onto the intermediate transfer body 10 in such a manner that the whole sheet is coated with the decolorable toner.

The printer configured as described above primarily transfers the decolorable toner image and the non-decolorable toner image onto the intermediate transfer body in order when the decolorable toner image is printed on the top on the sheet. The printer secondarily transfers the decolorable toner image and the non-decolorable toner image onto the sheet to fix them. As a result, the printer can fix the decolorable toner image on top of the non-decolorable toner image on the sheet. Therefore, the printer can use the decolorable toner as a clear toner, and can make the image glossy.

When printing the decolorable toner image on the underside of the sheet, the printer moves the secondary transfer roller and the cleaning blade away from the intermediate transfer body. The printer primarily transfers the non-decolorable toner image onto the intermediate transfer body. The printer rotates the intermediate transfer body until the non-decolorable toner image reaches the image forming section which primarily transfers the decolorable toner image. The printer primarily transfers the decolorable toner image using the corresponding image forming section by superimposing the decolorable toner image on the non-decolorable image. As a result, the printer can superimpose the decolorable toner image on the non-decolorable toner image without removing the non-decolorable toner image with the secondary transfer roller and cleaning blade.

Therefore, the printer can fix the non-decolorable toner image on top of the decolorable toner image on the sheet. Thus, the printer can use the decolorable toner to increase the thickness of the toner and can also effectively fix the non-decolorable toner image on an uneven sheet (i.e., to compensate for the unevenness).

The printer can select a hierarchical relationship between the decolorable toner and the non-decolorable toner.

Second Embodiment

Next, the second embodiment is described.

A printer according to the second embodiment is different from that of the first embodiment in that the image forming section 12 is located at the downstream side of the image forming sections 13 to 16. Besides, the same reference numerals are denoted to the other same components, and the detailed description thereof is omitted.

Figure 5:
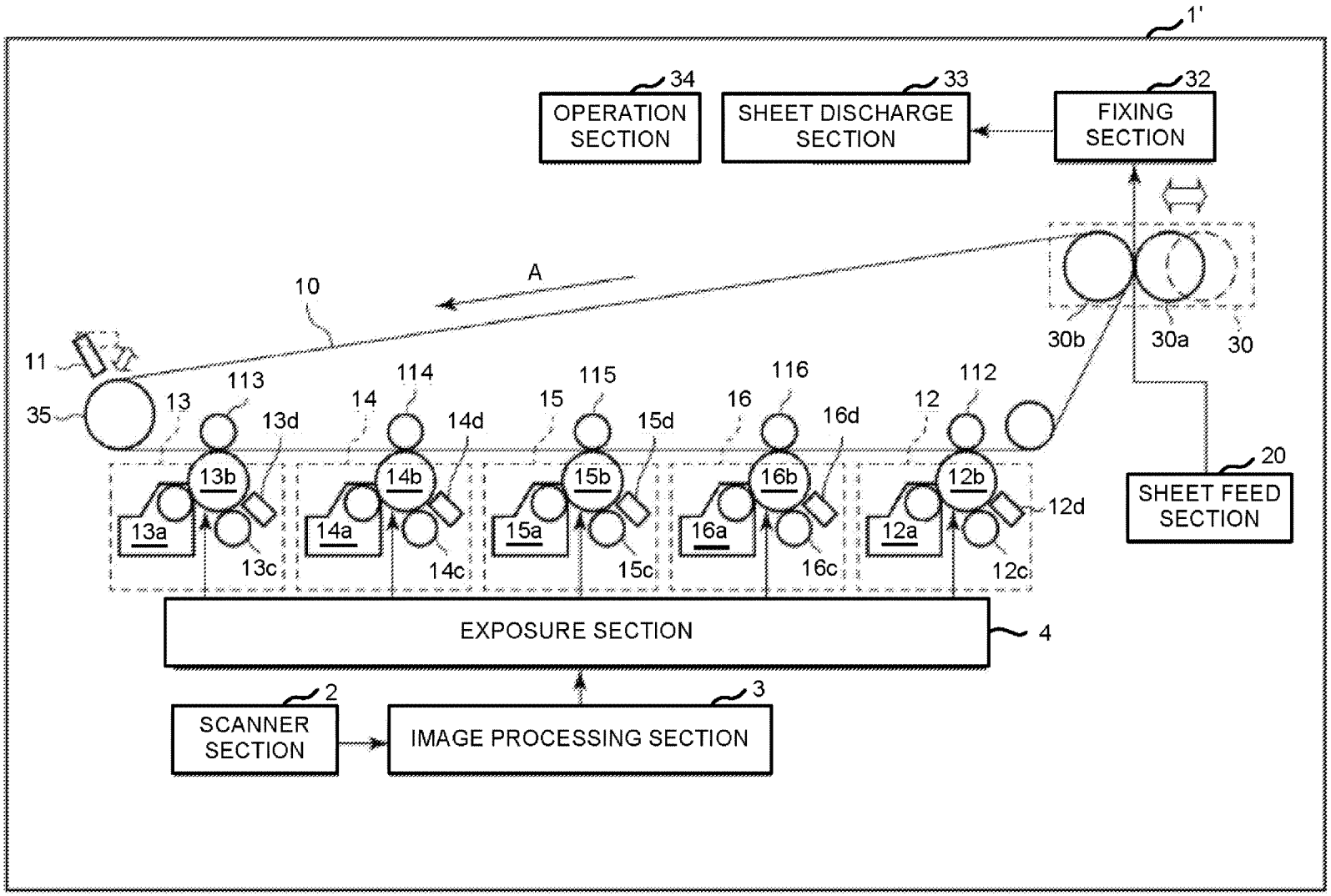
FIG. 5 is a diagram illustrating an example of a configuration of a printer according to a second embodiment.

FIG. 5 is a diagram illustrating an example of a configuration of the printer 1' according to the second embodiment.

The image forming sections 13 to 16 (first image forming device) form the non-decolorable toner images (first toner images) on the intermediate transfer body 10 using the non-decolorable toner.

The image forming sections 13 to 16 are installed at predetermined positions in order towards the downstream side along the intermediate transfer body 10.

The image forming section 12 (second image forming device) forms the decolorable toner image (second toner image) using the decolorable toner on the intermediate transfer body 10. The image forming section 12 is installed at the downstream side of the image forming sections 13 to 16.

In other words, the image forming sections 13, 14, 15, 16 and 12 are installed in order towards the downstream side.

The primary transfer rollers 112 to 116 are formed at positions respectively facing the image forming sections 12 to 16 across the intermediate transfer body 10.

Next, the function realized by the printer 1' is described. The function realized by the printer 1' is realized by the processor 41 executing a program stored in the ROM 42 or the NVM 44.

First, the processor 41 has a function of forming the decolorable toner image and the non-decolorable toner image on the intermediate transfer body 10 with the non-decolorable toner image below the decolorable toner image.

The processor 41 primarily transfers the non-decolorable toner images onto the intermediate transfer body 10 in a superimposed manner using the image forming sections 13 to 16. Specifically, the processor 41 superimposes the non-decolorable toner images on the intermediate transfer body 10 in a superimposed manner in the order of yellow (Y), magenta (M), cyan (C) and black (K).

If the non-decolorable toner image is primarily transferred onto the intermediate transfer body 10, the processor 41 primarily transfers the decolorable toner image onto the intermediate transfer body 10 using the image forming section by superimposing the decolorable toner image on the non-decolorable toner image. For example, the processor 41 controls the roller 35 and the like to primarily transfer the non-decolorable toner images on top of the decolorable toner image.

Specifically, the processor 41 forms the decolorable toner image on top of the non-decolorable toner images superimposed in the order of yellow (Y), magenta (M), cyan (C) and black (K).

The processor 41 also has a function of primarily transferring the decolorable toner image and the non-decolorable toner image onto the intermediate transfer body 10 with the decolorable toner image below the non-decolorable toner image.

The processor 41 moves the secondary transfer roller 30*a* away from the intermediate transfer body 10. In the initial state, if the secondary transfer roller 30*a* is separated from the intermediate transfer body 10, the processor 41 may not perform the above operation.

If the secondary transfer roller 30*a* is moved away from the intermediate transfer body 10, the processor 41 moves the cleaning blade 11 away from the intermediate transfer body 10. In the initial state, if the cleaning blade 11 is separated from the intermediate transfer body 10, the processor 41 may not perform the above operation.

If the cleaning blade 11 is moved away from the intermediate transfer body 10, the processor 41 primarily transfers the decolorable toner image onto the intermediate transfer body 10 using the image forming section 12.

If the decolorable toner image is primarily transferred onto the intermediate transfer body 10, the processor 41 rotates the intermediate transfer body 10 until the decolorable toner image reaches a position where the non-decolorable toner image is primarily transferred by being superimposed on the decolorable toner image. At this time, since the secondary transfer roller 30*a* and the cleaning blade 11 are moved away from the intermediate transfer body 10, the decolorable toner image is conveyed without being removed by the secondary transfer roller 30*a* and the cleaning blade 11.

If the intermediate transfer body 10 is rotated until the decolorable toner image reaches the position of the image forming section 13, the processor 41 primarily transfers the non-decolorable toner images onto the intermediate transfer body 10 using the image forming sections 13 to 16 by superimposing the non-decolorable toner images on the decolorable toner image. For example, the processor 41 controls the roller 35 and the like to primarily transfer the non-decolorable toner images on top of the decolorable toner image. Specifically, the processor 41 forms the non-decolorable toner images on top of the decolorable toner image on the intermediate transfer body 10 in a superimposed manner in the order of yellow (Y), magenta (M), cyan (C) and black (K).

The processor 41 may move the cleaning blade 11 and the secondary transfer roller 30*a* away from the intermediate transfer body 10 after primarily transferring the decolorable toner image. The processor 41 moves each of the cleaning blade and the secondary transfer roller 30*a* away from the intermediate transfer body 10 before the decolorable toner image passes through the secondary transfer roller 30*a* and the cleaning blade 11.

Figure 6:
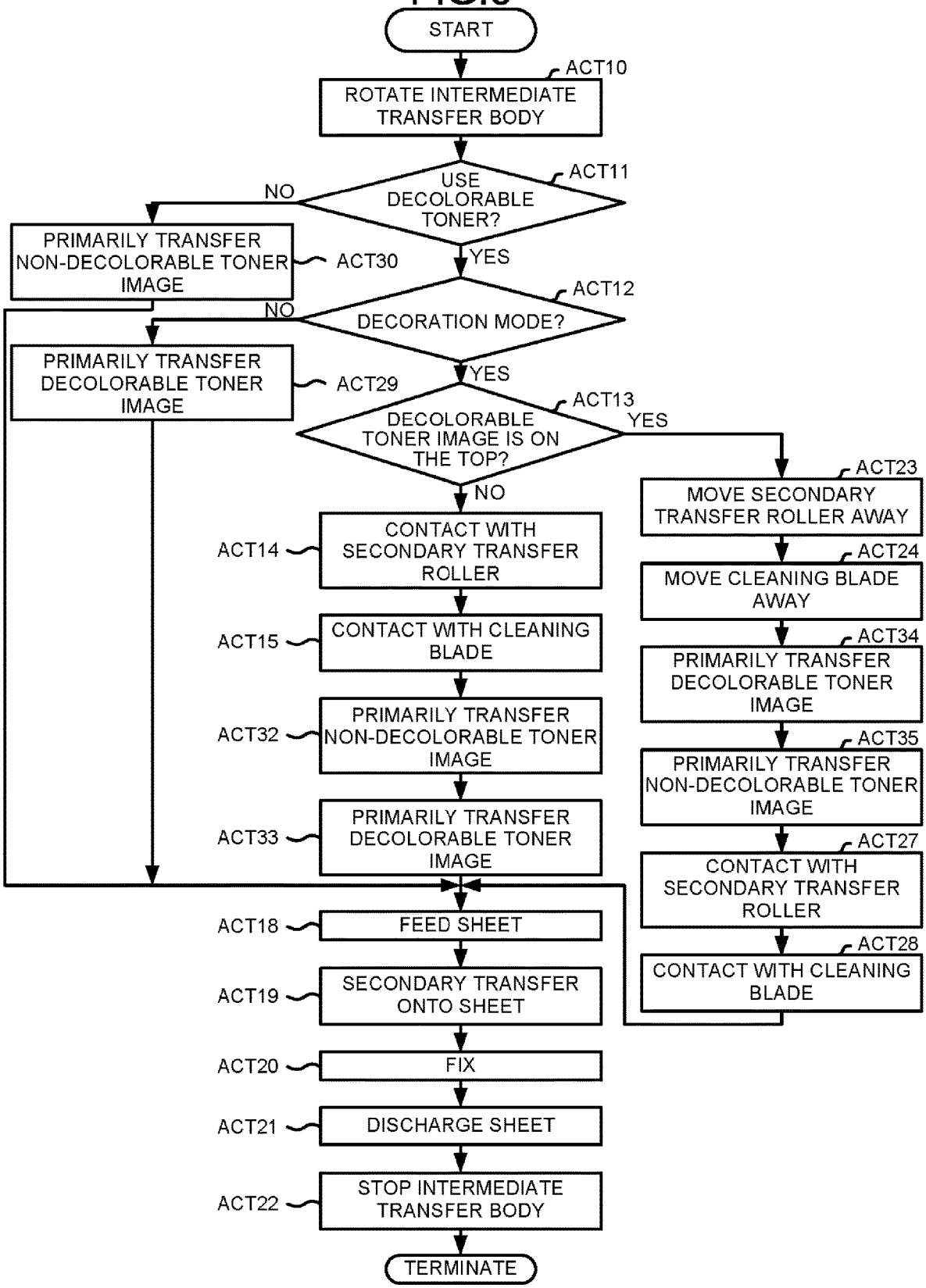
FIG. 6 is a flowchart depicting an example of the operation of a printer according to the second embodiment.

Next, an example of the operation by the printer 1' is described. FIG. 6 is a flowchart depicting an example of the operation by the printer 1'. Here, the same operations as those of the printer 1 according to the first embodiment are denoted with the same reference numerals, and the detailed description thereof is omitted.

If it is determined that the decoration mode is set (Yes in ACT 12), the processor 41 determines whether to print the decolorable toner image on top of the non-decolorable toner image (ACT 13). If it is determined to print the decolorable toner image on the underside of the non-decolorable toner image (No in ACT 13), the processor 41 proceeds to the processing in ACT 14.

If the cleaning blade 11 contacts with the intermediate transfer body 10 (ACT 15), the processor 41 primarily transfers the non-decolorable toner images onto the intermediate transfer body 10 in a superimposed manner using the image forming sections 13 to 16 based on the image data (ACT 32).

If the non-decolorable toner images are primarily transferred, the processor 41 primarily transfers the decolorable toner images onto the intermediate transfer body 10 using the image forming section 12 based on the image data by superimposing the decolorable toner image on the non-decolorable toner images (ACT 33). If the decolorable toner image is primarily transferred, the processor 41 proceeds to the processing in ACT 18.

Furthermore, if the cleaning blade 11 is moved away from the intermediate transfer body 10 (ACT 24), the processor 41 primarily transfers the decolorable toner image onto the intermediate transfer body 10 using the image forming section 12 based on the image data (ACT 34).

If the decolorable toner image is primarily transferred, when the decolorable toner image on the intermediate transfer body 10 reaches the image forming section 13, the processor 41 primarily transfers the non-decolorable toner images onto the intermediate transfer body 10 using the image forming sections to 16 based on the image data by superimposing the non-decolorable toner images on the decolorable toner image (ACT 35). If the non-decolorable toner images are primarily transferred, the processor 41 proceeds to the processing in ACT 27.

The processor 41 may form the decolorable toner images on the top and the underside of the non-decolorable toner image on the intermediate transfer body 10. For example, the processor 41 moves the secondary transfer roller 30*a* and the cleaning blade 11 away from the intermediate transfer body 10. If the secondary transfer roller 30*a* and the cleaning blade 11 are moved away, the processor 41 primarily transfers the decolorable toner image onto the intermediate transfer body 10 using the image forming section 12. If the decolorable toner image is primarily transferred onto the intermediate transfer body 10, the processor 41 rotates the intermediate transfer body 10 until the decolorable toner image reaches the image forming section 13. After the intermediate transfer body 10 is rotated, the processor 41 primarily transfers the non-decolorable toner image on top of the decolorable toner image using the image forming sections 13 to 16. If the non-decolorable toner image is primarily transferred, the processor 41 further primarily transfers the decolorable toner image by using the image forming section 12. If the decolorable toner image is primarily transferred, the processor 41 secondarily transfers the decolorable toner image and the non-decolorable toner images from the intermediate transfer body 10 onto the sheet to fix them on the sheet.

The printer configured as described above has the image forming sections for primarily transferring the non-decolorable toner image and the image forming section for primarily transferring the decolorable toner image in order towards the downstream side. As a result, the printer can fix the non-decolorable toner images and the decolorable toner image without rotating the intermediate transfer body in a case of fixing the decolorable toner image on the underside of the non-decolorable toner image on the sheet.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A printer, comprising:

a sheet feeder configured to feed a sheet;

an intermediate transfer body formed as a belt;

a first image forming device configured to primarily transfer a first toner image formed with first toner onto the intermediate transfer body;

a second image forming device, arranged at a downstream side of the first image forming device in a direction in which the intermediate transfer body rotates, configured to primarily transfer a second toner image formed with second toner onto the intermediate transfer body;

a secondary transfer roller, arranged at a downstream side of the second image forming device, configured to secondarily transfer the first toner image and the second toner image from the intermediate transfer body onto the sheet;

a processor configured to primarily transfer the first toner image onto the intermediate transfer body using the first image forming device, primarily transfer the second toner image onto the intermediate transfer body using the second image forming device by superimposing the second toner image on the first toner image, secondarily transfer the first toner image and the second toner image onto the sheet using the secondary transfer roller, or cause the secondary transfer roller to move away from the intermediate transfer body, primarily transfer the second toner image onto the intermediate transfer body using the second image forming device, cause the intermediate transfer body to rotate until the second toner image reaches a position of the first image forming device, primarily transfer the first toner image onto the intermediate transfer body using the first image forming device by superimposing the first toner image on the second toner image, so as to permit the secondary transfer roller to contact the intermediate transfer body, and secondarily transfer the first toner image and the second toner image onto the sheet using the secondary transfer roller;

a fixer configured to fix the first toner image and the second toner image on the sheet; and a cleaning blade, installed at a downstream side of the secondary transfer roller, configured to remove toner from the intermediate transfer body, wherein the processor is configured to cause the cleaning blade to move away from the intermediate transfer body before the second toner image passes through the cleaning blade.

2. The printer according to claim 1, wherein the first toner is decolorable toner, the second toner is non-decolorable toner, and the fixer is configured to heat the second toner image at a temperature at which the decolorable toner is decolorable.

3. The printer according to claim 1, wherein the first toner is non-decolorable toner, the second toner is decolorable toner, and the fixer is configured to heat the first toner image at a temperature at which the decolorable toner is decolorable.

4. The printer according to claim 1, wherein the processor is configured to cause the cleaning blade to move away from the intermediate transfer body when the secondary transfer roller is moved away from the intermediate transfer body.

5. The printer of claim 1, wherein the processor is configured to superimpose a decolorable toner image on a non-decolorable toner image without removing the non-decolorable toner image via the secondary transfer roller and the cleaning blade.

6. The printer of claim 5, wherein the fixer is configured to fix the non-decolorable toner image on top of the decolorable toner image on the sheet so as to increase a toner thickness and compensate for unevenness of the sheet.

7. The printer of claim 1, wherein the processor is configured to cause the cleaning blade to contact the intermediate transfer body when the secondary transfer roller contacts the intermediate transfer body.

8. A printing method, comprising:

feeding a sheet;

in a case of fixing a second toner image formed with second toner on an underside of a first toner image formed with first toner on the sheet:

primarily transferring the first toner image onto an intermediate transfer body formed as a belt using a first image forming device, primarily transferring the second toner image onto the intermediate transfer body using a second image forming device which is arranged at a downstream side of the first image forming device in a direction in which the intermediate transfer body rotates by superimposing the second toner image on the first toner image, and secondarily transferring the first toner image and the second toner image onto the sheet using a secondary transfer roller which is arranged at a downstream side of the second image forming device;

in a case of fixing the second toner image on top of the first toner image on the sheet:

moving the secondary transfer roller away from the intermediate transfer body, primarily transferring the second toner image onto the intermediate transfer body using the second image forming device, rotating the intermediate transfer body until the second toner image reaches a position of the first image forming device, primarily transferring the first toner image onto the intermediate transfer body using the first image forming device by superimposing the first toner image on the second toner image, causing the secondary transfer roller to contact the intermediate transfer body, and secondarily transferring the first toner image and the second toner image onto the sheet using the secondary transfer roller;

fixing the first toner image and the second toner image on the sheet, removing toner from the intermediate transfer body by a cleaning blade installed at a downstream side of the secondary transfer roller, and causing the cleaning blade to move away from the intermediate transfer body before the second toner image passes through the cleaning blade.

9. The printing method according to claim 8, wherein the first toner is decolorable toner, the second toner is non-decolorable toner, and the method further comprises heating the second toner image at a temperature at which the decolorable toner is decolorable.

10. The printing method according to claim 8, wherein the first toner is non-decolorable toner, the second toner is decolorable toner, and the method further comprises heating the first toner image at a temperature at which the decolorable toner is decolorable.

11. The printing method according to claim 8, further comprising moving the cleaning blade away from the intermediate transfer body when the secondary transfer roller is moved away from the intermediate transfer body.

12. The printing method of claim 8, further comprising superimposing a decolorable toner image on a non-decolorable toner image without removing the non-decolorable toner image using the secondary transfer roller and cleaning blade.

13. The printing method of claim 12, further comprising fixing the non-decolorable toner image on top of the decolorable toner image on the sheet so as to increase a toner thickness and compensate for unevenness of the sheet.

14. The printing method of claim 8, further comprising causing the cleaning blade to contact the intermediate transfer body when the secondary transfer roller contacts the intermediate transfer body.

* * * * *